US006167577B1

(12) United States Patent
Hammad

(10) Patent No.: US 6,167,577 B1
(45) Date of Patent: Jan. 2, 2001

(54) PERSONAL HYGIENE DEVICE, TOILET BIDET

(76) Inventor: Adman Hammad, 9 Rutgers La., Middlesex, NJ (US) 08846

( * ) Notice: Under 35 U.S.C. 154(b), the term of this patent shall be extended for 0 days.

(21) Appl. No.: 08/848,480

(22) Filed: May 8, 1997

(51) Int. Cl.[7] ..... A47K 3/22
(52) U.S. Cl. ..... 4/420.4
(58) Field of Search ..... 4/443–448, 420.1–420.5

(56) References Cited

U.S. PATENT DOCUMENTS 2,278,055 * 3/1942 Bigio ..... 4/448
2,605,477 * 8/1952 Monserrat ..... 4/448
4,092,744 * 6/1978 Butoi ..... 4/447
4,135,255 * 1/1979 Menendez ..... 4/448
4,926,509 * 5/1990 Bass ..... 4/448
5,272,774 * 12/1993 Ivko et al. ..... 4/420.4

* cited by examiner

*Primary Examiner*—Charles R. Eloshway

(57) ABSTRACT

A bidet is device that clamps to the side of the toilet bowl and connects to existing hot and cold water lines. A mixing valve is provided to adjust the temperature of the output water. A bracket fastens the bidet to the rim of the toilet bowl. A spray wand having a nozzle on the operative end functions to deliver water and soap to the genital area of an individual. A liquid soap dispenser is further provided to dispense soap from the bidet spray nozzle. The spray wand is retractable to the side of the toilet bowl when not in use.

7 Claims, 9 Drawing Sheets

PERSONAL HYGIENE DEVICE, TOILET BIDET

BACKGROUND OF THE INVENTION

1. Field of the Invention

The present invention relates to toilet structures. More particularly, the present invention relates to a toilet bowl bidet attachment for rinsing a genital area of an individual 2. Description of the Prior Art The use of toilet bowl strictures is known in the art. Specifically, toilet structures heretofore devices and utilized are known to consist of familiar, expected and obvious structural configurations. A number of solutions have been proposed for a combination toilet bowl and bidet; none, however, are both retrofittable and connectable to both hot and cold water supplies.

Numerous innovations for Toilet Bidets have been provided in the prior art that are described as follows. Even though these innovations may be suitable for the specific individual purposes to which they address, they differ from the present invention as hereinafter contrasted.

In U.S. Pat. No. 5,495,625, titled Toilet Bowl Bidet Attachment, invented by Thayard A. McGuire, an attachment for rinsing the genital area of an individual is disclosed. The device includes a water supply assembly coupleable to hot and cold water supply lines and positionable in adjacency relative to a toilet. A nozzle conduit in fluid communication with the water supply assembly extends through an aperture in the toilet bowl to direct water onto the genital area of a user. The water supply assembly includes a pair of valves for hot and cold water. Each of the valves having a body with a hollow portion which receives respective toilet seat mounting bolts on opposing sides of the toilet bowl, and a handle extending from the valve body.

The present invention differs from the above described patented invention because the patented invention, while attaching to both hot and cold water sources requires an aperture in the toilet bowl. This aperture precludes easily retrofitting the patented invention to existing toilet bowls. Further, the patented invention, once installed is permanently located in the central front area. No provisions are made to for its removal.

In U.S. Pat. No. 5,452,483, tiled Bidet Apparatus for use in Toilet Fixtures, invented by Rafael J. Dizon, Jr. a bidet apparatus for use in toilet bowl of the type having a flush tank is disclosed. The apparatus defines a valve operated mechanism having a valve regulator, an associated valve seat housing, and a water conveyance block. The housing has a water leading hole in communication with a conveyance tube whose free end defines a directable spray nozzle. The block has an inlet and outlet passageways communicably connected through the leading hole. The inlet and outlet passageways are connected to the water supply source and the flush tank of the bowl, respectively. A mounting bracket for connection to the bowl is secured on the mechanism and laterally extends therefrom.

The present invention differs from the above described patented invention because the patented invention, is attached to a single water source. The patented invention positions the spray nozzle toward the rear of the toilet bowl and is rigidly mounted. The present invention mounts the spray nozzle on the side of the toilet bowl with provisions to rotate the spray nozzle into position in a central region of the toilet bowl. The spray is nested in the side of the toilet bowl until needed. The present invention is attached to both hot and cold water supplies. The present invention is attached to the side of the toilet bowl with a clamping bracket and a single locking screw.

In U.S. Pat. No. 5,287,566, titled Sanitary Bidet Conversion Kit for Conventional Toilet Bowls, invented by Teodoro C. Azada, a sanitary bidet conversion kit for conventional water closet flush toilets is disclosed. The kit includes a T-shaped pipe to be connected the toilet tank water supply, a nozzle mounted in an upward direction within the toilet bowl and a hose including a flow control valve connected between the T-shaped pipe and nozzle. The nozzle includes a cover pivotally mounted thereto which moves under the influence of gravity to cover the nozzle outlet when water flow through the nozzle is stopped.

The present invention differs from the above described patented invention because the patented invention, is attached to a single water source. The exhaust orifice is located in the rear of the toilet and has a cover biased by a spring in a closed position. Water pressure opens the cover. No spray orifice is disclosed other than the exit of water from a pipe end.

In U.S. Pat. No. 5,271,104, tiled Toilet Bidet, invented by Salvatore C. LaTora, a toilet bidet provides a cold water supply hose for attachment to an existing toilet's filler tube, may include a heating unit mounted to the side of the existing toilet tank, a water delivery hose leading to a bracket housing mounted on the rim of the existing toilet bowl, and a pivotable bidet arm directing the water upwards through a bidet nozzle towards the center of the toilet bowl. The heating unit is activated by a tank-mounted switching having a float switch or switch arm extending beneath the exiting toilet's float arm, so that each time the toilet is flushed, and the float arm falls with the dropping water level in the tank, the float switch or switch arm is depressed, thereby activating the heating unit.

The present invention differs from the above described patented invention because the patented invention, while attaching to a cold water source comprises a heating unit to provide hot water each time the toilet is flushed. The patented invention fastens to the mounting means for the toilet seat by a bracket. A pivot arm is mounted such that an axis of rotation is inclined slightly from vertical which biases the pivot arm to rotate toward the outside of the toilet bowl. The pivot arm is conveyed into an operating position by water pressure pushing against a splash plate. The patented invention is mounted by a bracket to the side of the toilet bowl.

Numerous innovations for Toilet Bidet have been provided in the prior art that are adapted to be used. Even though these innovations may be suitable for the specific individual purposes to which they address, they would not be suitable for the purposes of the present invention as heretofore described.

SUMMARY OF THE INVENTION

The prior art disadvantages are overcome by the present invention. The present invention is an easily retrofittable device that clamps to the side of the toilet bowl and connects to existing water lines located at the toilet bowl input and the vanity hot water line. The general purpose of the present invention is to provide a combination toilet and bidet apparatus and method which has advantages not anticipated by the prior art.

The present invention generally comprises an attachment to existing toilet bowls for rinsing the genital area of an individual. The inventive device includes a water coupling to both a hot and cold water supply. A mixing valve is provided to adjust the temperature of the output water. A bracket fastens the bidet to the rim of the toilet bowl. A spray wand having a nozzle on the operative end functions to deliver water and soap the genital area of an individual. The spray wand is biased by a spring to rest, in a retracted position, against the inside of the toilet bowl. When the user activates the bidet water flows to a thrust nozzle which functions to force the spray wand away from the toilet bowl side toward an operative position. A soap dispenser is further provided to dispense a soap from the bidet spray nozzle. The spray wand of the present invention retracts to the side of the toilet bowl when not in use.

The types of problems encountered in the prior art are a special purpose bidet is required which consumes valuable bathroom space and is considerably more expensive to purchase and install than the present invention.

In the prior art, unsuccessful attempts to solve this problem were attempted, namely: purpose built toilets with combined use having a single source of water, and conversion kits which are complex to install on existing toilets. However, the problem was solved by the present invention because a bracket fastens the present invention to the toilet bowl side and simple connections couple to the input hot and cold water lines. Further, a simple retraction means stores the nozzle of the present invention when not in use.

Innovations within the prior art are rapidly being exploited with the rapid acceptance of the bidet as a common apparatus.

The present invention solved a need for a bidet which could be easily adapted to existing toilets.

Accordingly, it is an object of the present invention to provide a clamping means adapter to a toilet rim which securely fastens the bidet to the toilet rim.

More particularly, it is an object of the present invention to provide a spray of water centrally and upwardly in a toilet bowl.

In keeping with these objects, and with others which will become apparent hereinafter, one feature of the present invention resides, briefly stated, in a spray wand which extends upon use and retracts on completion.

In accordance with another feature of the present invention, a thrust nozzle operates against a biasing spring to move the spray wand to an operable position.

Another feature of the present invention is that both hot and cold water sources are used.

Yet another feature of the present invention is that a mixing valve adjusts the temperature of the output water.

Still another feature of the present invention is that a soap dispenser may be engaged to provide a spray of soap through the spray nozzle.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing(s).

Brief List of Reference Numerals Utilized in the Drawing

10—toilet bidet (10)
12—bidet device (12)
12A—spray wand (12A)
12AA—spray wand swivel joint (12AA)
12AB—spray wand return spring (12AB)
12ACA—spray wand first upright (12ACA)
12ACB—spray wand horizontal member (12ACB)
12ACC—spray wand nozzle support (12ACC)
12ACCA—spray wand threads (12ACCA)
12ACD—spray wand tee (12ACD)
12ACDA—spray wand tee threads (12ACDA)
12AD—spray wand nozzle (12AD)
12ADA—nozzle housing (12ADA)
12ADB—nozzle orifice (12ADB)
12ADC—orifice spray pattern (12ADC)
12ADD—nozzle threads (12ADD)
12AE—spray wand thrust nozzle (12AE)
12AEA—thrust nozzle housing (12AEA)
12AEB—thrust nozzle orifice (12AEB)
12AEC—thrust nozzle cavity (12AEC)
12AED—stream (12AED)
12AEE—thrust nozzle threads (12AEE)
12B—spray wand supply hose (12B)
12BA—supply hose coupling (12BA)
12C—mounting bracket (12C)
12CA—mounting bracket top (12CA)
12CB—mounting bracket outer vertical member (12CB)
12CBA—fastening bolt (12CBA)
12CBAA—knob (12CBAA)
12CBAB—thread shaft (12CBAB)
12CC—mounting bracket inner vertical member (12CC)
12CD—mounting bracket swivel attachment (12CD)
12CDA—mounting bracket swivel attachment aperture (12CDA)
12CE—mounting bracket stop (12CE)
12D—soap dispenser (12D)
12DA—tee connector (12DA)
12DB—connector (12DB)
12DC—dispenser hose (12DC)
12DD—valve (12DD)
12DDA—handle (12DDA)
12DE—reservoir (12DE)
12E—mixer valve (12E)
12EA—body (12EA)
12EAA—stem (12EAA)
12EAB—handle (12EAB)
12EB—coupling (12EB)
12EC—hot water coupling (12EC)
12ED—cold water coupling (12ED)
14—cold water inlet (14)
16—hot water inlet (16)
18—opening/closing direction (18)

Second Embodiment

110—second toilet bidet (110)
112—bracket (112)
112F—bracket front (112F)
112FA—bracket front horizontal (112FA)
112FB—bracket front vertical (112FB)
112FC—bracket front top (112FC)
112FD—bracket front rear (112FD)
112R—bracket rear (112R)
112RA—bracket rear horizontal (112RA)
112RB—bracket rear vertical (112RB)
112RC—bracket rear top (112RC)
112RD—bracket rear rear (112RD)
112M—middle (112M)
112MA—middle slot (112MA)
114—carriage (114)
114A—carriage vertical (114A)

114AA—carriage upper mounting tab (114AA)
114AB—carriage lower mounting tab (114AB)
114B—carriage top (114B)
114BA—carriage top indents (114BA)
114C—carriage rear (114C)
114D—carriage rear left projection (114D)
114E—carriage rear right projection (114E)
114F—carriage rear slide (114F)
116—dispenser (116)
116A—dispenser nozzle (116A)
116B—dispenser elbow section (116B)
116C—dispenser horozontal section (116C)
116C'—dispenser horozontal section stowed position (116C')
116D—dispenser vertical section (116D)
116E—dispenser delivery tube (116E)
116F—dispenser control valve (116F)
116FA—dispenser control valve knob (116F)
116G—dispenser connection tube (116G)
116H—dispenser soap dispenser (116H)
116HA—dispenser valve (116HA)
116HAA—dispenser valve know (116HA)
116HB—soap dispenser (116HB)
116I—hot water inlet (116I)
116J—cold water inlet (116J)
118—attachment means (118)
120—four way tee (120)
120A—first tee member (120A)
120B—second tee member (120B)
120C—lower tee member (120C)
120D—upper tee member (120D)
122—operative lever (122)
122'—operative lever (122')
122A—operative lever shaft (122A)
122B—operative lever shaft detent (122B)
122C—operative lever path (122C)
124—cover (124)
126—operating path (126)
128—stowing path (128)

BRIEF DESCRIPTION OF THE PREFERRED EMBODIMENT

DETAILED DESCRIPTION OF THE PREFERRED EMBODIMENT

Figure 1:
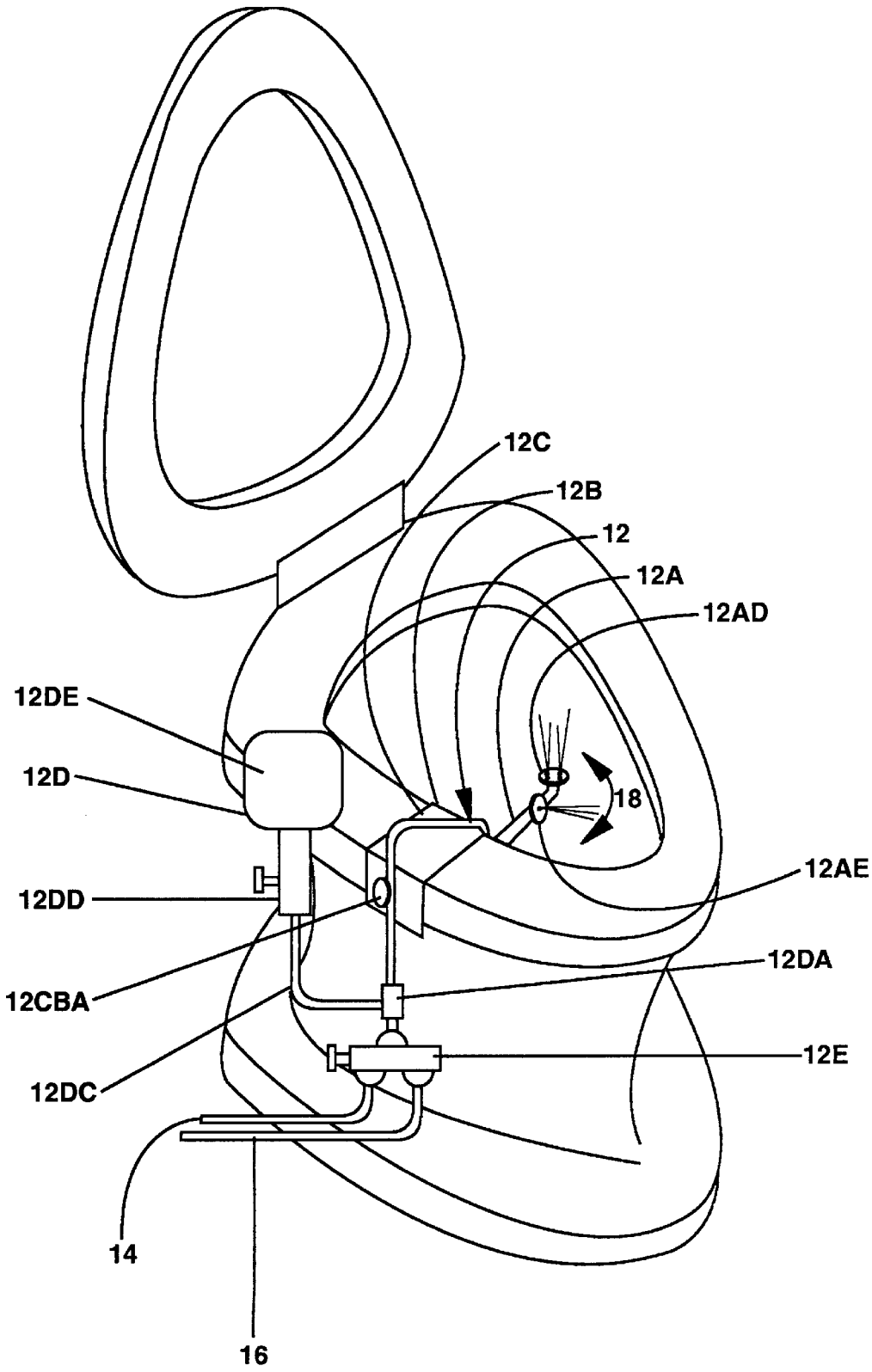
FIG. 1 is a perspective view of a toilet bidet.
Figure 2:
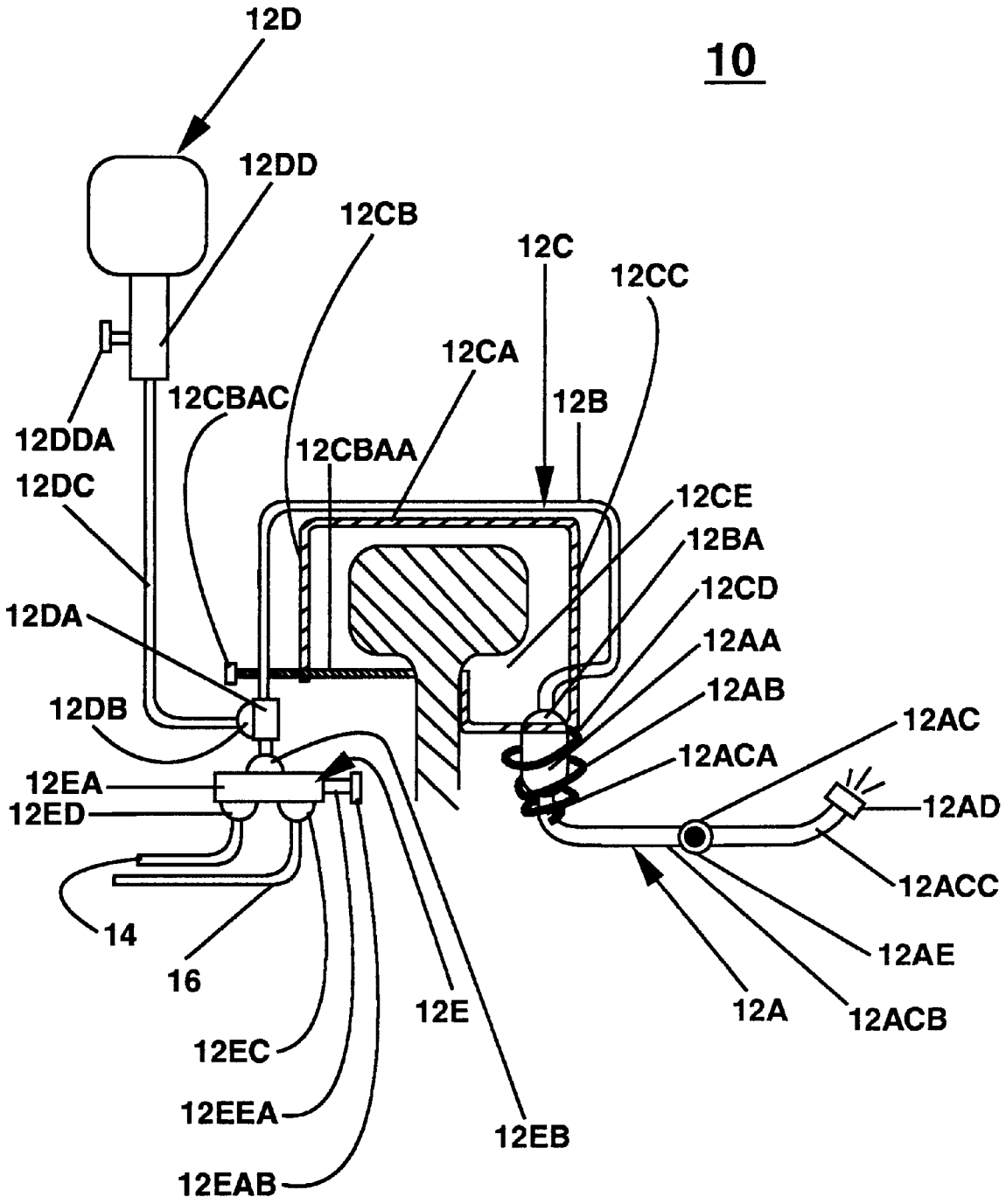
FIG. 2 is a cross sectional view of a toilet bidet installed over on a toilet rim.

Firstly, referring to FIG. 1 which is a perspective view of a toilet bidet (10) having the following features: bidet device (12), spray wand (12A), spray wand nozzle (12AD), spray wand thrust nozzle (12AE), spray wand supply hose (12B), mounting bracket (12C), fastening bolt (12CBA), soap dispenser (12D), tee connector (12DA), valve (12DD), dispenser hose (12DC), reservoir (12DE), mixer valve (12E), cold water inlet (14), hot water inlet (16), opening closing direction (18).

A bidet device (12) comprises a spray wand (12A) having a spray wand nozzle (12AD) securely attached at one distal end. The spray wand nozzle (12AD) functions to form and direct a water spray upwardly. The spray wand (12A) further comprises a spray wand thrust nozzle (12AE) securely attached horizontally to a mid distal point of the spray wand (12A). The spray wand thrust nozzle (12AE) functions to provide a stream of water in a horizontal direction forcing the spray wand (12A) to move along an opening/closing direction (18). The opposite distal end of the spray wand (12A) is rotatably attached to a proximal end of spray wand supply hose (12B) which functions to transport water to the spray wand (12A). The spray wand (12A) is securely fastened to the rim of a toilet by a mounting bracket (12C) and fastening bolt (12CBA). The opposite distal end of the spray wand supply hose (12B) is securely attached to a tee connector (12DA). The a first input to the tee connector (12DA) is securely attached to a soap dispenser (12D) at one distal end of a dispenser hose (12DC). The opposite distal end of the dispenser hose (12DC) is securely attached to a proximal end of a valve (12DD). The distal end of the valve (12DD) is securely attached to a reservoir (12DE). The reservoir (12DE) contains a liquid soap which is dispensed through the spray wand nozzle (12AD) when a user operates the valve (12DD) in an open position.

A second input to the tee connector (12DA) is securely attached to the output of a mixer valve (12E). A first input of a mixer valve (12E) is securely attached to a cold water inlet (14). A second input to the mixer valve (12E) is securely attached to a hot water inlet (16). The cold water inlet (14) and hot water inlet (16) are in communication with hot and cold water sources respectively. The mixer valve (12E) functions to control the flow rate and temperature of the water existing from the spray wand thrust nozzle (12AE).

The spray wand (12A) and component parts are made from materials selected from a group consisting of metal, metal alloy, plastic, plastic composite, and rubber.

The mixer valve (12E) and valve (12DD) are made from materials selected from a group consisting of metal, metal alloy, plastic, plastic composite, and rubber.

The soap dispenser (12D) is made from materials selected from a group consisting of metal, metal alloy, plastic, plastic composite, and rubber.

Secondly, FIGS. 2–5 show a bidet device (12) installed on a toilet rim having the following features: spray wand (12A), spray wand swivel joint (12AA), spray wand return spring (12AB), spray and first upright (12ACA), spray wand horizontal member (12ACB), spray wand nozzle support (12ACC), spray wand threads (12ACCA), spray wand tee (12ACD), spray wand tee threads (12ACDA), spray wand nozzle (12AD), nozzle housing (12ADA), nozzle orifice (12ADB), orifice spray pattern (12ADC), nozzle threads (12ADD), spray wand thrust nozzle (12AE), thrust nozzle housing (12AEA), thrust nozzle orifice (12AEB), thrust nozzle cavity (12AEC), stream (12AED), thrust nozzle threads (12AEE), spray wand supply hose (12B), supply hose coupling (12BA), mounting bracket (12C), mounting bracket top (12CA), mounting bracket outer vertical member (12CB), fastening bolt (12CBA), knob (12CBAB), threaded shaft (12CBAA), mounting bracket inner vertical member (12CC), mounting bracket swivel attachment (12CD), mounting bracket swivel attachment aperture (12CDA), mounting bracket stop (12CE), soap dispenser (12D), tee connector (12DA), connector (12DB), dispenser hose (12DC), valve (12DD), handle (12DDA), reservoir (12DE), mixer valve (12E), body (12EA), stem (12EAA), handle (12EAB), coupling (12EB), hot water coupling (12EC), cold water coupling (12ED), cold water inlet (14), and hot water inlet (16).

A bidet device (12) comprises a spray wand (12A). The spray wand (12A) comprises a spray wand nozzle (12AD) securely attached at one distal end of a spray wand nozzle support (12ACCC). The spray wand nozzle (12AD) functions to form and direct a water spray upwardly. The opposite distal end of the spray wand nozzle support (12ACC) is securely attached to a proximal end of a spray wand horizontal member (12ACB). The spray wand horizontal member (12ACB) is securely attached at a mid distal end to one distal end of a spray wand tee (12ACD). The opposite distal end of the spray wand tee (12ACD) securely attached to the spray wand thrust nozzle (12AE). The spray wand thrust nozzle (12AE) functions to provide a stream of water in a horizontal direction. The spray wand horizontal member (12ACB) is rotatably attached at an opposite distal end to a lower distal end of a spray wand first upright (12ACA). An upper distal end of the spray wand first upright (12ACA) is securely attached to a spray wand swivel joint (12AA). The spray wand swivel joint (12AA) is securely attached to a mounting bracket swivel attachment (12CD) at a mounting bracket swivel attachment aperture (12CDA).

When the user operates the bidet device (12) the thrust from the spray wand thrust nozzle (12AE) causes the spray wand (12A) to rotate from an initial position against the toilet bowl rim in a horizontal plane about the spray wand swivel joint (12AA) to an operative position. A spray wand return spring (12AB) is securely fastened at one distal end to the spray wand first upright (12ACA). The opposite distal end of the spray wand return spring (12AB) is securely attached to a mounting bracket swivel attachment (12CD). The spring is biased to return the spray wand (12A) to a first position when the user has completed using the bidet device (12).

The spray wand swivel joint (12AA) is securely attached to the proximal end of the spray wand supply hose (12B) by a supply hose coupling (12BA). The distal end of the spray wand supply hose (12B) is securely attached to an output of the tee connector (12DA).

A first input to the tee connector (12DA) is securely attached to a soap dispenser (12D) at one distal end of a dispenser hose (12DC) by a connector (12DB). The opposite distal end of the dispenser hose (12DC) is securely attached to a proximal end of a valve (12DD). The distal end of the valve (12DD) is securely attached to a reservoir (12DE). The reservoir (12DE) contains a liquid soap which is dispensed through the spray wand nozzle (12AD) when an user operates the valve (12DD) by turning a handle (12DDA) in an opening direction. A second input to the tee connector (12DA) is securely attached to the output of a body (12EA) of the mixer valve (12E) by a coupling (12EB).

The body (12EA) is securely attached by a cold water coupling (12ED) to the cold water inlet (14) by a cold water coupling (12ED). The body (12EA) is securely attached by a hot water coupling (12EC) to the hot water inlet (16) by a hot water coupling (12EC). The cold water inlet (14) and hot water inlet (16) are securely attached to hot and cold water sources respectively. The mixer valve (12E) further comprises a stem (12EAA) rotatably attached to the body (12EA) at one distal end and to a central portion of a handle (12EAB) at the opposite distal end. The mixer valve (12E) functions to control the flow and mixing of the hot water source and cold water source when a user operates the handle (12EAB) from a first and off position through a second and mid position at which the flow and temperature satisfy the user.

The bidet device (12) further comprises a mounting bracket (12C) which functions to fasten the spray wand (12A) to a toilet bowl rim. The mounting bracket (12C) comprises a mounting bracket top (12CA) securely and orthogonally attached to an upper distal edge of a mounting bracket outer vertical member (12CB). The mounting bracket outer vertical member (12CB) comprises a bolt (12CBA) having a threaded shaft (12CBAA) which cooperates with a threaded aperture located at a lower portion of the mounting bracket outer vertical member (12CB) such that the threaded shaft (12BAA) when extended contacts the toilet bowl below the rim. The threaded shaft (12CBAA) is securely attached at an outboard end to the central portion of a knob (12BAB). When the knob (12CBAB) is rotated in a first direction the threaded shaft (12CBAA) threads inwardly until making contact with the toilet bowel. A further tightening of the knob (12CBAB) provides a compressive force on the toilet bowl bringing the mounting bracket stop (12CE) against the opposite side of the toilet bowl rim. The mounting bracket stop (12CE) is securely fastened along a lower distal edge to a proximal edge of the mounting bracket swivel attachment (12CD).

Figure 3:
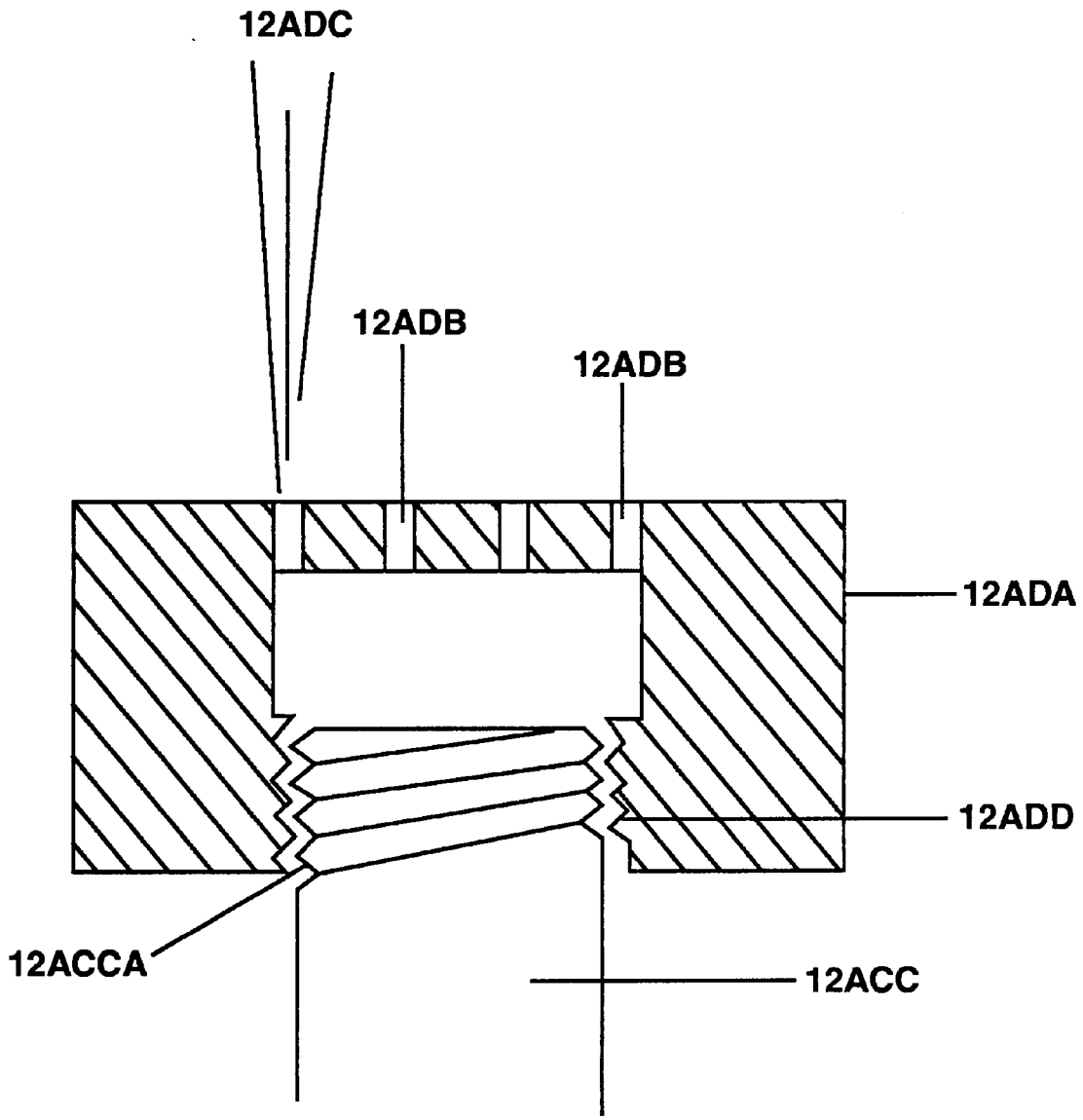
FIG. 3 is a cross section view of a spray nozzle.

Thirdly, referring to FIG. 3 which is a cross section view of a spray wand nozzle (12AD) having the following features: spray wand nozzle support (12ACC), spray wand threads (12ACCA), nozzle housing (12ADA), nozzle orifice (12ADB), orifice spray pattern (12ADC), and nozzle threads (12ADD).

The spray wand nozzle (12AD) comprises a nozzle housing (12ADA) having a central hollow cavity closed at one end. The closed end of the nozzle housing (12ADA) has at least one nozzle orifice (12ADB) therethrough. The at least one nozzle orifice (12ADB) functions to produce an orifice spray pattern (12ADC) when water is exhausted therethrough. A nozzle thread (12ADD) is securely attached to an inner wall of the cavity at an open end. The nozzle thread (12ADD) is in cooperative engagement with a spray wand thread (12ACCA) located at a proximal end of the spray wand nozzle support (12ACC).

Figure 5:
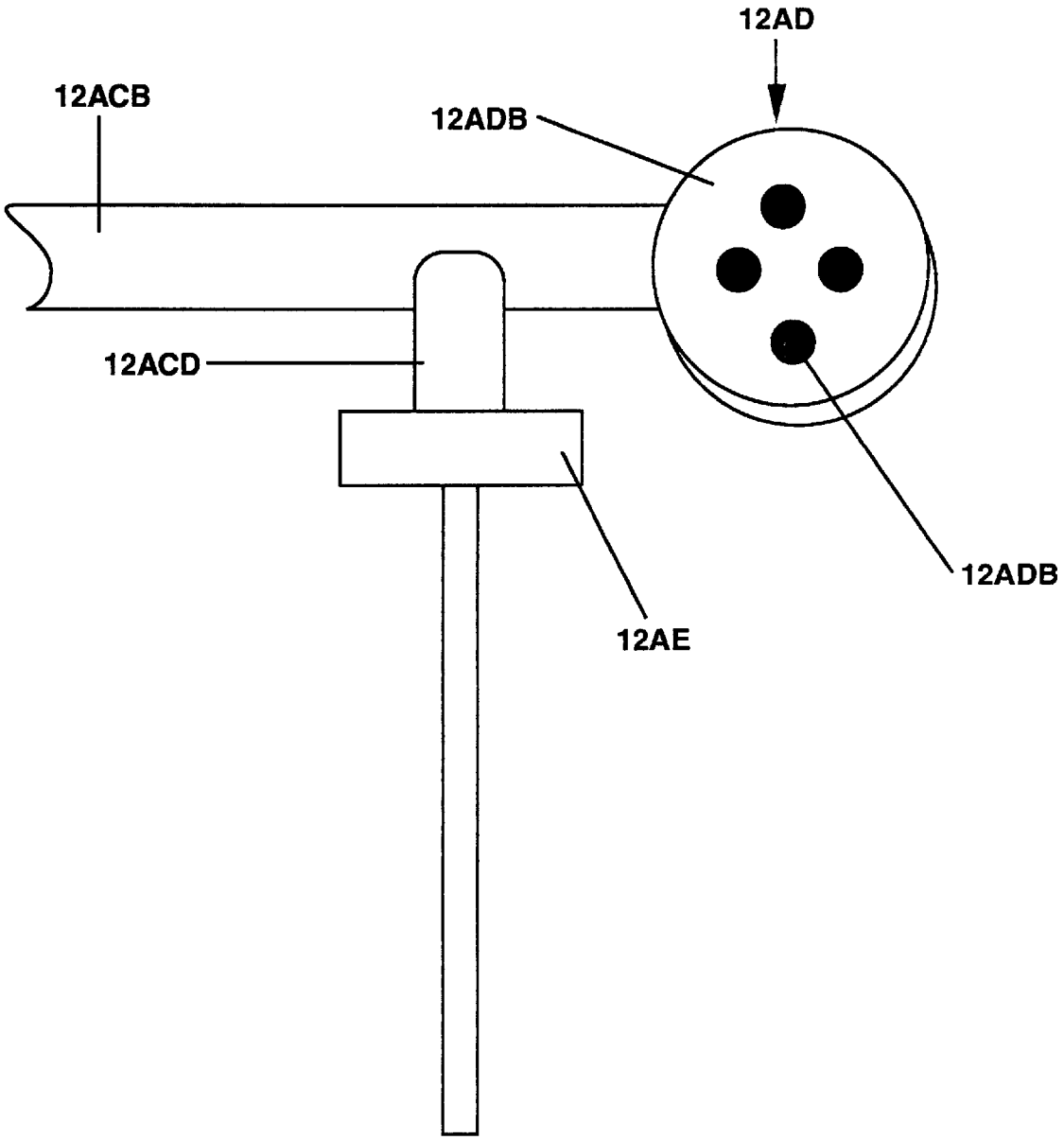
FIG. 5 is a cross section view of a thrust nozzle.
Figure 6:
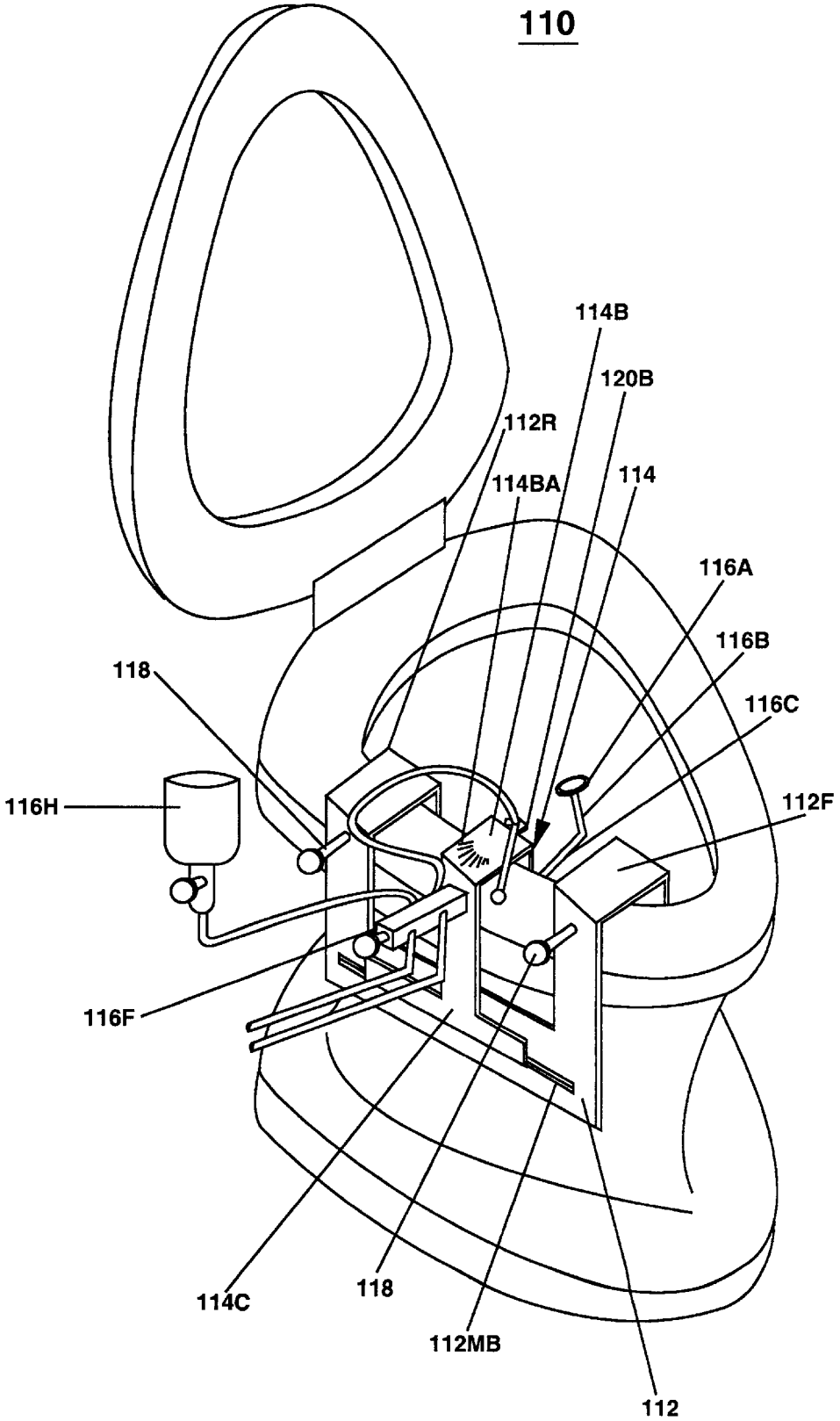
FIG. 6 is a perspective view of a second toilet bidet mounted on a toilet.
Figure 7:
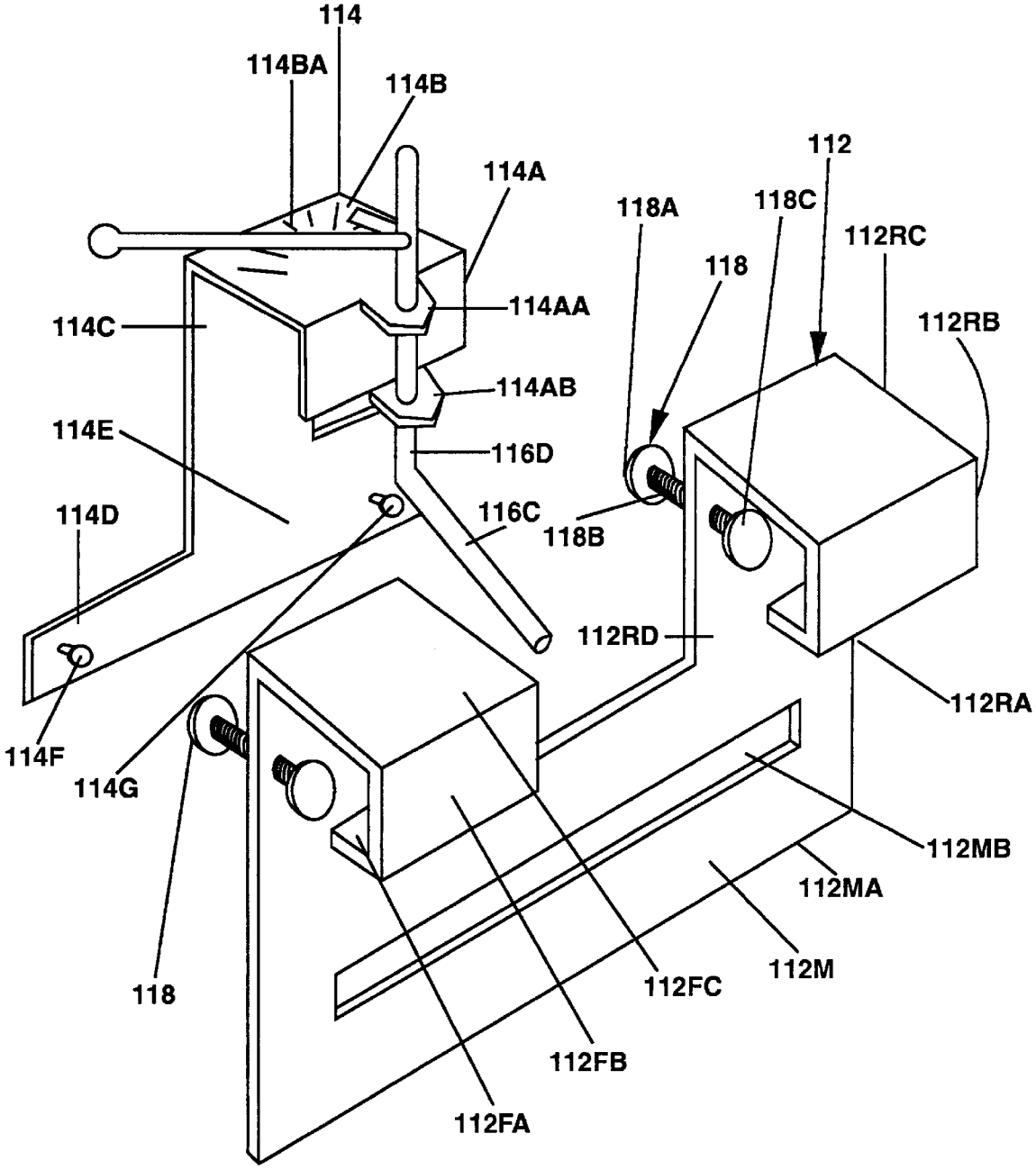
FIG. 7 is an exploded view of a second toilet bidet.
Figure 8:
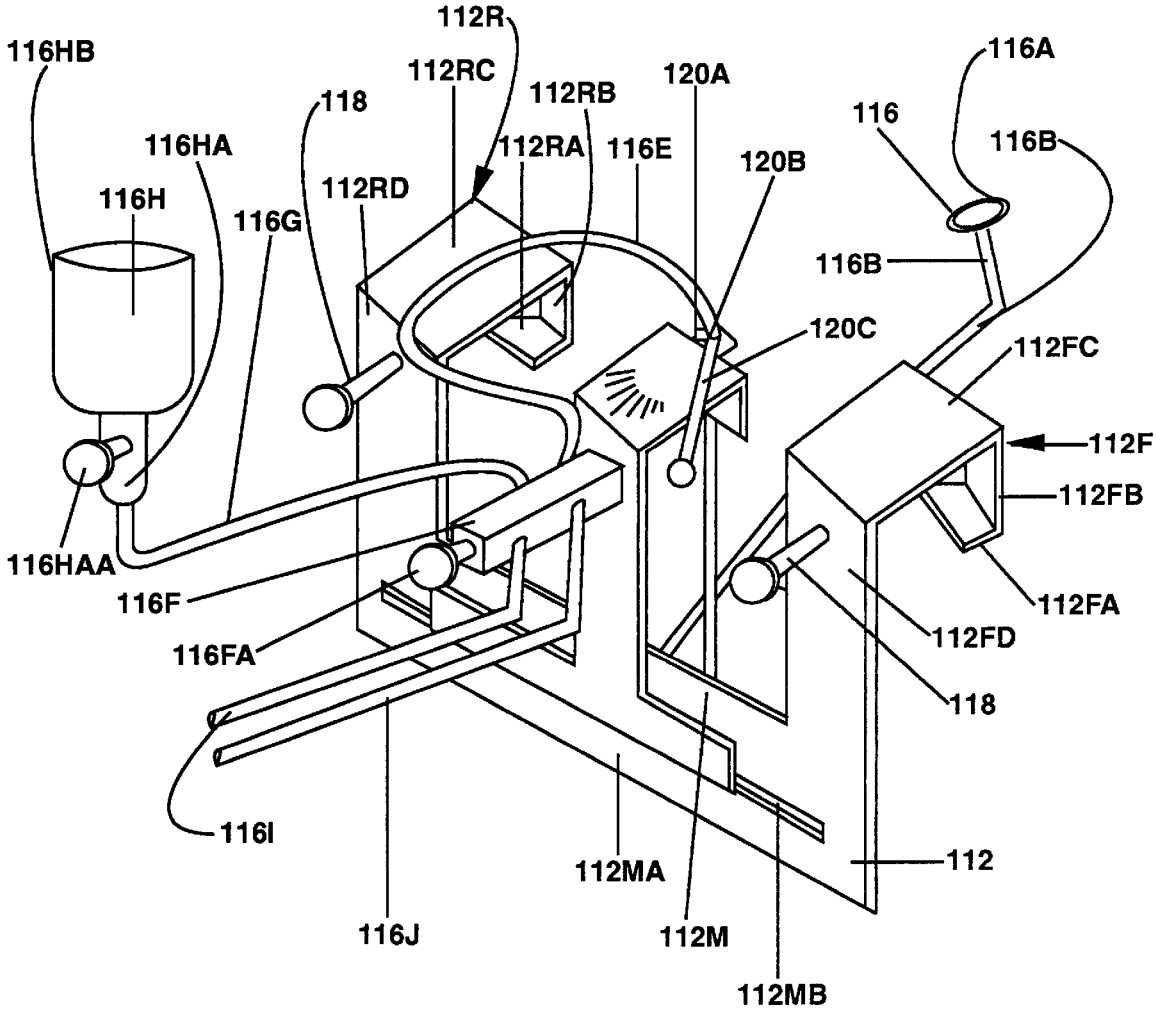
FIG. 8 is a perspective view of a second toilet bidet.
Figure 9:
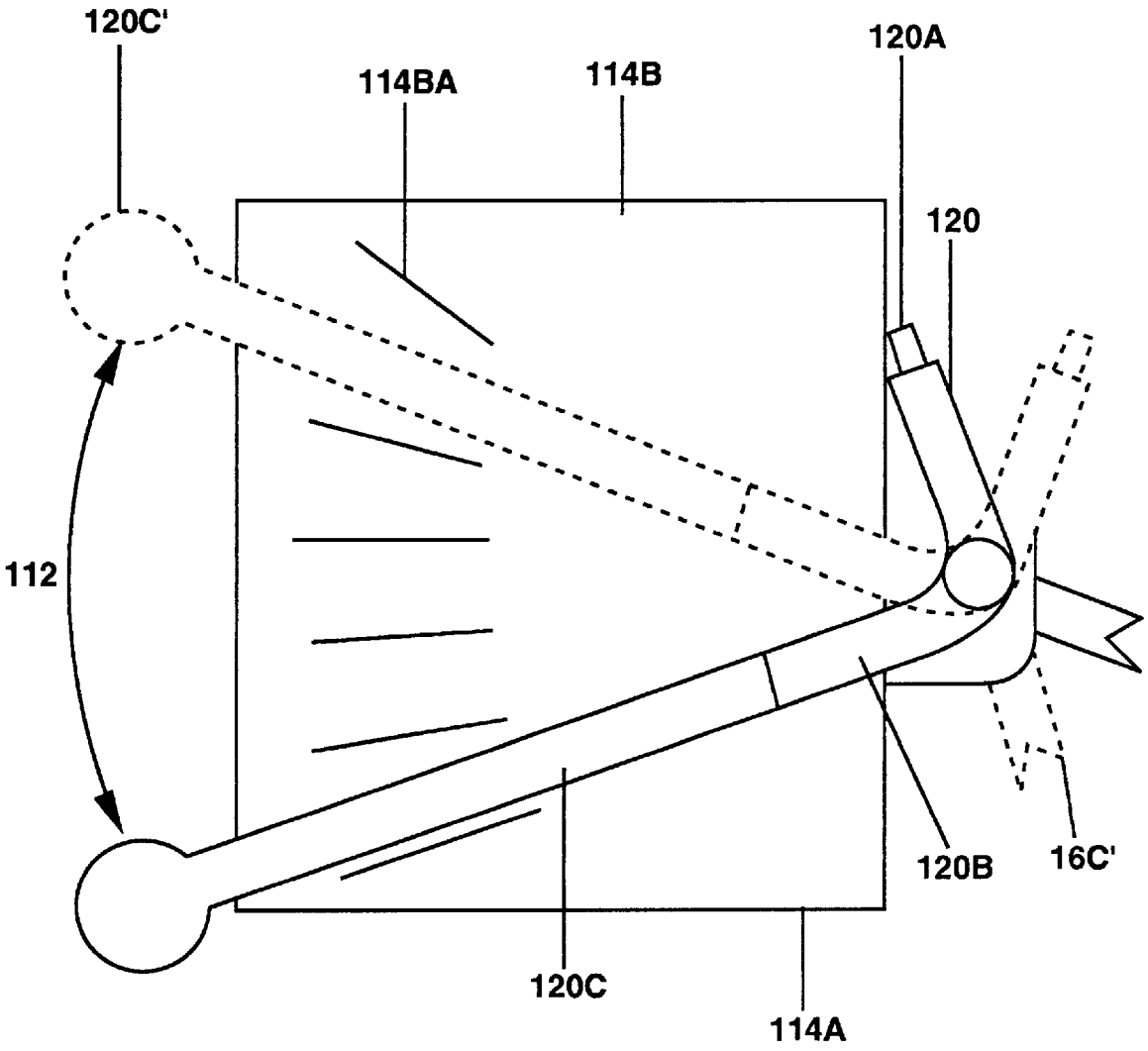
FIG. 9 is a top view of a spray nozzle deployment means

Fourthly, referring to FIG. 5 which is a top view of a spray wand (12A) showing a spray wand thrust nozzle (12AE) and a spray wand nozzle (12AD): spray wand horizontal member (12ACB), spray wand tee (12ACD), spray wand thrust nozzle (12AE), spray wand nozzle (12AD), nozzle housing (12ADA), and nozzle orifice (12ADB).

The spray wand horizontal member (12ACB) is securely attached at a medial distal point to a proximal end of a spray wand tee (12ACD). The distal end of the spray wand tee (12ACD) is securely attached to a spray wand thrust nozzle (12AE). The spray wand thrust nozzle (12AE) functions to provide a horizontal fluid stream. The spray wand nozzle (12AD) comprises a nozzle housing (12ADA) having at least one nozzle orifice (12ADB).

Figure 4:
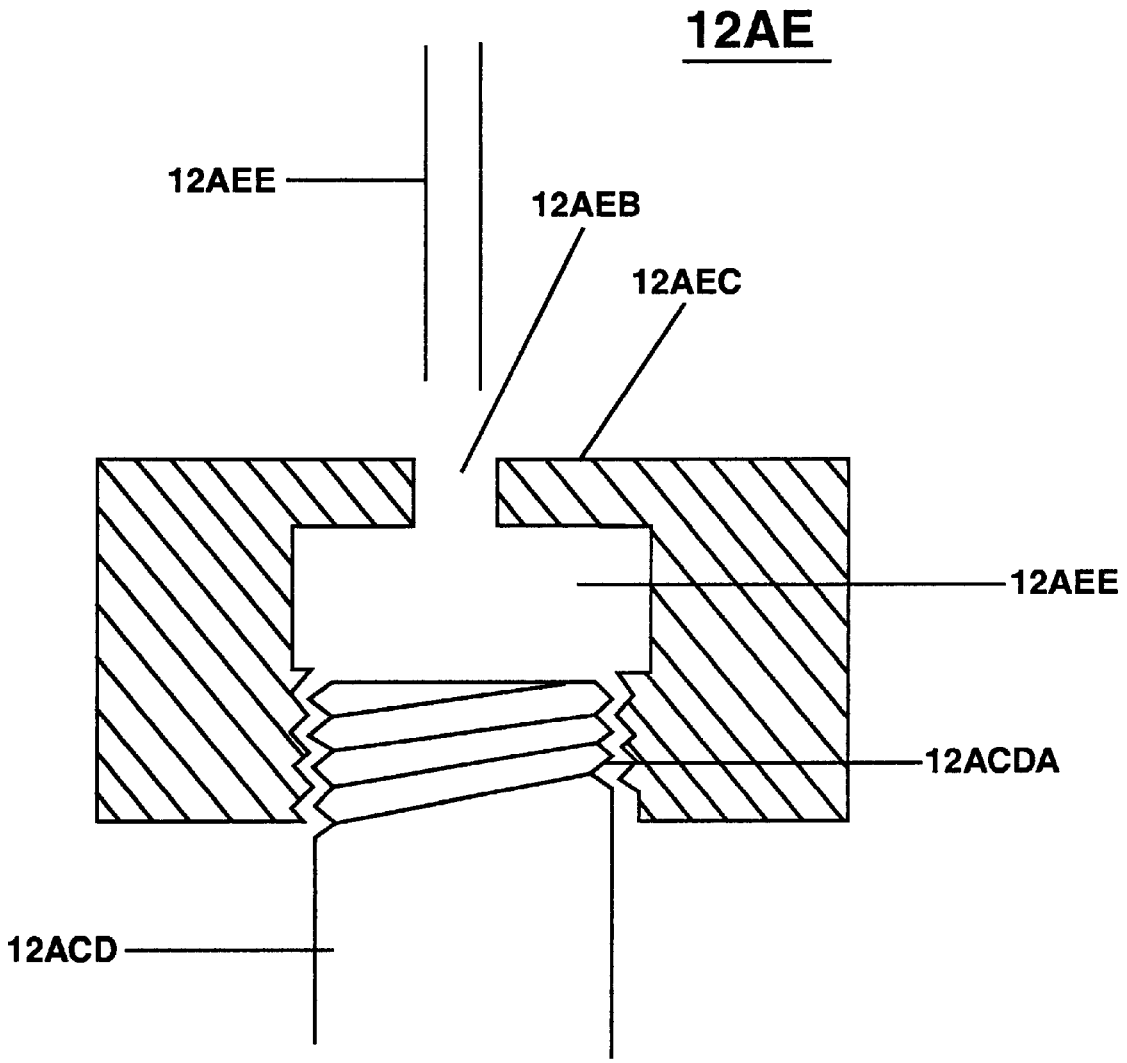
FIG. 4 is a top view of a spray wand showing a thrust nozzle and a spray nozzle.

Lastly, referring to FIG. 4 which is a cross section view of a spray wand thrust nozzle (12AE) having the following features: spray wand nozzle thrust nozzle (12AE), thrust nozzle housing (12AEA), thrust nozzle orifice (12AEB), thrust nozzle cavity (12AEC), stream (12AED), thrust nozzle threads (12AEE), spray wand tee (12ACD), and spray wand tee threads (12ACDA).

The spray wand nozzle (12AE) comprises a thrust nozzle housing (12AEA) having a closed end and an open end which define a thrust nozzle cavity (12AEC). The closed end comprises one thrust nozzle orifice (12AEB) which functions to direct exhaust water under pressure in a stream (12AED) pattern. The stream (12AED) is aimed perpendicular to the spray wand horizontal member (12ACB) which results in a perpendicular force. The spray wand thrust nozzle (12AE) is securely attached to the spray wand tee (12ACD) by a thrust nozzle thread (12AEE) which cooperate with a spray wand tee thread (12ACDA) that are securely attached a proximal end of the spray wand tee (12ACD).

Now, referring to FIGS. 6–9, a perspective view of a second toilet bidet (110) is shown attached to a toilet bowl rim. The second toilet bidet (110) comprises a bracket (112). The bracket (112) comprises a bracket front (112F). The bracket front (112F) comprises a bracket front horizontal (112FA) positioned horizontal and securely attached along one edge to a lower edge of a bracket front vertical (112FB). An upper edge of the bracket front vertical (112FB) is securely attached to one distal edge of a bracket front top (112FC). The opposite distal edge of the bracket front top (112FC) is securely attached to an upper edge of a bracket front rear (112FD). A lower distal edge of the bracket front rear (112FD) is securely attached to an upper distal edge at one distal edge of a middle (112M).

The opposite distal end of the middle (112M) is securely attached along an upper distal edge to the lower distal edge of a bracket rear rear (112RD), an upper distal edge of the bracket rear rear (112RD) is securely attached to one distal edge of a bracket rear top (112RC). The opposite distal edge of the bracket rear top (112RC) is securely attached to an upper distal edge of a bracket rear vertical (112RB). The opposite distal edge of the bracket rear vertical (112RB) is securely attached to a proximal edge of a bracket rear horizontal (112RA). The bracket rear rear (112RD), bracket rear top (112RC), bracket rear vertical (112RB), and bracket rear horizontal (112RA) comprise a bracket rear (112R). The middle (112M) comprises a middle slot (112MA).

The bracket front (112F) is removably attached to the toilet by an attachment means (118). The bracket rear (112R) is removably attached to the toilet by an attachment means (118). The attachment means (118) is selected from a group consisting of screws, bolts, adhesive tapes, glue, and clips. The bracket (112) functions to removably and securely fasten the second toilet bidet (110) to a toilet rim.

The second toilet bidet (110) further comprises a carriage (114). The carriage (114) comprise a carriage vertical (114A) having an upper edge. The carriage vertical (114A) further comprises a carriage upper mounting tab (114AA) and a carriage lower mounting tab (114AB) securely attached perpendicular thereto. The carriage vertical (114A) is securely attached along an upper edge orthogonally to a proximal edge of a carriage top (114B). The carriage top (114B) comprises at least one carriage top indent (114BA), a distal edge of the carriage top (114B) is securely attached perpendicular to a carriage rear (114C). The carriage rear (114C) at a lower left distal side is securely attached to a proximal side of a carriage rear left projection (114D). The carriage rear left projection (114D) comprises at least one carriage rear slide (114F). The carriage rear (114C) at a lower right distal side is securely attached to a proximal side of a carriage rear right projection (114E). The carriage rear right projection (114E) comprises at least one carriage rear slide (114G). The at least one carriage rear slide (114G) slidably engages a middle slot (112MA). The carriage (114) is moves along an operating path (126), having a forward limit and an aft limit, controlled by an user.

The second toilet bidet (110) still further comprises a dispenser (116) which comprises a dispenser nozzle (116A) attached to one distal end of a dispenser elbow section (116B) at an optimum upward angle relative to horizontal which has been found through experimentation to be 45 degrees. The dispenser elbow section (116B) functions to direct a liquid spray from the dispenser nozzle (116A) at the genital areas of a human. The carriage (114) is moved along an operating path (126) from a forward limit which places the dispenser nozzle (116A) in a stowed position under the toilet bowl rim, to an operable position starting preferably two inches from the front of the toilet. The movement along the operating path (126) permits the user to adjust the position to adapt to size and gender. The opposite distal end of the dispenser elbow section (116B) is securely attached to a dispenser horizontal section (116C) which is maintained substantially horizontal.

The dispenser horizontal section (116C) is rigid but somewhat malleable to permit the user to bend it to conform to the shape of an inside of a toilet bowl when in retracted to a dispenser horizontal section stowed position (116C'). An opposite distal end of the dispenser horizontal section (116C) is securely attached to a proximal end of a dispenser vertical section (116D). A distal end of the dispenser vertical section (116D) is securely attached to a lower tee member (120C) of a four way tee (120). The four way tee (120) further comprises a lower tee member (120C) which is securely attached to an upper distal end of the dispenser vertical section (116D).

The lower tee member (120C) is rotationally attached to the carriage vertical (114A) by the carriage lower mounting tab (114AB). The four way tee (120) further comprises a first tee member (120A). The first tee member (120A) is securely attached orthogonal to an upper end of the dispenser vertical section (116D).

The four way tee (120) still further comprises a second tee member (120B) which is securely attached orthogonal to an upper end of the dispenser vertical section (116D) and to a proximal end of the first tee member (120A). The upper end of the lower tee member (120C) is securely attached to a lower end of an upper tee member (120D). The lower tee member (120C) and the upper tee member (120D) are hollow permitting the passage of fluid there through. The upper tee member (120D) is rotationally attached to the positioning means by a carriage upper mounting tab (114AA), an upper end of the upper tee member (120D) is securely attached to a proximal end of a dispenser delivery tube (116E).

The opposite distal end of the dispenser delivery tube (116E) is securely attached to an output of a dispenser control valve (116F). The dispenser control valve (116F) comprises a dispenser control valve knob (116F) which functions to control the flow of fluid through the dispenser control valve (116FA). The user adjusts the flow of fluid through the through the dispenser control valve (116FA) and the temperature of the fluid as it comes out of the dispenser control valve (116A) by adjusting the knob (116FA). The dispenser control valve (116FA) is manufactured from materials selected from a group consisting of metal, metal alloy, plastic, plastic composite, and rubber.

The dispenser control valve (116FA) is further connected to one distal end of at least one dispenser connection tube (116G). The opposite distal of the at least one dispenser connection tube (116G) is securely attached to at least one dispenser soap dispenser (116H).

The soap dispenser (116H) is manufactured from materials selected from a group consisting of metal, metal alloy, plastic, plastic composite, and rubber. The at least on dispenser soap dispenser (116H) comprises a dispenser valve (116HA). The dispenser valve (116HA) comprises a dispenser valve knob (116HAA) which functions to control the flow of fluid from the at least one dispenser soap dispenser (116H). The at least one dispenser soap dispenser (116H) further comprises at least one soap dispenser (116HB) which functions to contain a fluid. The dispenser control valve (116F) is further attached to a hot water inlet (116I). The dispenser control valve (116F) is still further attached to a cold water inlet (116J). The dispenser control valve (116F) functions to control the mixture of hot and cold water through the dispenser (116) to provide a comfortable temperature of fluid to the user at the dispenser nozzle (116A).

The dispenser (116) is manufactured from materials selected from a group consisting of metal, metal alloy, plastic, plastic composite, and rubber.

The second toilet bidet (110) further comprises an operative lever (122). The operative lever (122) comprises an operative lever shaft (122A) which is securely and removably attached on one distal end to the first tee member (120A) for a right sided installation and to a second tee member (120B) for a left sided installation. The operative lever shaft (122A) comprises an operative lever shaft detent (122B) which cooperates with the at least one carriage top indent (114BA) to movably secure the operative lever (122) in a selected position. The operative lever (122) when moved from a first position to a second position (122') along an operative lever path (122C) positions the dispenser nozzle (116A) from a stowed position under the toilet bowl rim to an operable position where the dispenser nozzle (116A) is directed at the genital area of a human.

The second toilet bidet (110) further comprises a cover (124). The cover (124) is hingably attached to the bracket (112) at a position selected from a group consisting of a lower edge, a right edge, a left edge, and a top edge. The cover is fastened in a closed position by a releasable fastening means. A spring biased hinge can be used to return the cover to a closed position.

It will be understood that each of the elements described above, or two or more together, may also find a useful application in other types of constructions differing from the type described above.

While the invention has been illustrated and described as embodied in a Toilet Bidet, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essentially characteristics of the generic or specific aspects of this invention.

What is claimed as new and desired to be protected by Letters Patent is set forth in the appended claims.

What is claimed is:

1. A second toilet bidet (110) for use on a toilet having a toilet bowl comprising:

A) a bracket (112) which comprises a bracket front (112F), the bracket front (112F) comprises a bracket front horizontal (112FA) positioned horizontally and securely attached along one edge to a lower edge of a bracket front vertical (112FB), an upper edge of the bracket front vertical (112FB) is securely attached to one distal edge of a bracket front top (112FC), the opposite distal edge of the bracket front top (112FC) is securely attached to an upper edge of a bracket front rear (112FD), a lower distal edge of the bracket front rear (112FD) is securely attached to an upper distal edge at one distal end of a middle (112M), the opposite distal end of the middle (112M) is securely attached along an upper distal edge to the lower distal edge of a bracket rear rear (112RD), an upper distal edge of the bracket rear rear (112RD) is securely attached to one distal edge of a bracket rear top (112RC), the opposite distal edge of the bracket rear top (112RC) is securely attached to an upper distal edge of a bracket rear vertical (112RB), the opposite distal edge of the bracket rear vertical (112RB) is securely attached to a proximal edge of a bracket rear horizontal (112RA), the bracket rear rear (112RD), bracket rear top (112RC), bracket rear vertical (112RB), and bracket rear horizontal (112RA) comprise a bracket rear (112R), the middle (112M) comprises a middle slot (112MA), the bracket front (112F) is adapted to be removably attached to the toilet of an attachment means (118), the bracket rear (112R) is adapted to be removably attached to the toilet by an attachment means (118);

B) a carriage (114), the carriage (114) comprises a carriage vertical (114A) having an upper edge, the carriage vertical (114A) further comprises a carriage upper mounting tab (114AA) and a carriage lower mounting tab (114AB) securely attached perpendicularly thereto, the carriage vertical (114A) is securely attached along an upper edge orthogonally to a proximal edge of a carriage top (114B), the carriage top (114B) comprises at least one carriage top indent (114BA), a distal edge of the carriage top (114B) is securely attached perpendicular to a carriage rear (114C), the carriage rear (114C) at a lower left distal side is securely attached to a proximal side of a carriage rear left projection (114D), the carriage rear left projection (114D) comprises at least one carriage rear slide (114F), the carriage rear (114C) at a lower right distal side is securely attached to a proximal side of a carriage rear right projection (114E), the carriage rear right projection (114E) comprises at least one carriage rear slide (114G), the at least one carriage rear slides (114F) and (114G) slidably engage the middle slot (112MA); for positional adjustment of the carriage (114) on the bracket (112);

C) a dispenser (116) which comprises a dispenser nozzle (116A) attached to one distal end of a dispenser elbow section (116B) at an upward angle relative to horizontal to direct a liquid spray from the dispenser nozzle (116A) at the genital areas of a human seated on the toilet, the opposite distal end of the dispenser elbow section (116B) is securely attached to a dispenser horizontal section (116C) which is maintained substantially horizontal, the dispenser horizontal section (116C) is rigid and substantially malleable to permit the user to bend it to conform to the shape of an inside of the toilet bowl when retracted to a dispenser stowed position (116C'), an opposite distal end of the dispenser horizontal section (116C) is securely attached to a proximal end of a dispenser vertical section (116D), a distal end of the dispenser vertical section (116D) is securely attached to a lower tee member (120C) of a four way tee (120), the lower tee member (120C) is rotationally attached to the carriage (114) by carriage upper and lower mounting tabs (114AA) and (114AB), the four way tee (120) further comprises a first tee member (120A), the first tee member (120A) is securely attached orthogonally to lower tee member (120C), the four way tee (120) still further comprises a second tee member (120B) which is securely attached orthogonally to lower tee member (120C) proximate first tee member (120A), the upper end of the lower tee member (120C) is securely attached to a lower end of an upper tee member (120D), the lower tee member (120C) and the upper tee member (120D) are hollow permitting the passage of fluid there through, is an upper end of the upper tee member (120D) is securely attached to a proximal end of a dispenser delivery tube (116E), the opposite distal end of the dispenser delivery tube (116E) is securely attached to an output of a dispenser control valve (116F), the dispenser control valve (116F) comprises a dispenser control valve knob (116FA) which functions to control the flow of fluid through the dispenser control valve (116F), the dispenser control valve (116F) is further connected to one distal of at least one dispenser connection tube (116G), the opposite distal end of the at least one dispenser connection tube (116G) is securely attached to at least one dispenser soap dispenser (116H), the at least one dispenser soap dispenser (116H) comprises a dispenser valve (116HA), the dispenser valve (116HA) comprises a dispenser valve knob (116HAA) which functions to control the flow of fluid from the at least one dispenser soap dispenser (116H), the dispenser control valve (116F) is further attached to a hot water inlet (116I) and to a cold water inlet, the dispenser control valve (116F) functions to control the mixture of hot and cold water through the dispenser (116) to provide a comfortable temperature of fluid to the user at the dispenser nozzle (116A);

D) an operative lever (122) comprises an operative lever shaft (122A) which is securely and removably attached on one distal end to one of the first tee member (120A) and second tee member (120B) the operative lever shaft (122A) comprises an operative lever shaft detent (122B) which cooperates with the at least one carriage top indent (114BA) to movably secure the operative lever (122) in a selected position.

2. The toilet bidet (110) as described in claim 1, wherein the attachment means (118) is selected from the group consisting of screws, bolts, adhesive tapes, glue, and clips.

3. The toilet bidet (110) as described in claim 1, wherein the upward angle of the dispenser nozzle (116A) is 45 degrees.

4. The toilet bidet (110) as described in claim 1, further comprises a cover (124), the cover (124) is adapted to be attached to the bracket (112).

5. The toilet bidet (110) as described in claim 1, wherein the dispenser (116) is comprised of materials selected from the group consisting of metal, metal alloy, plastic composite, and rubber.

6. The toilet bidet (110) as described in claim 1, wherein the dispenser control valve (116F) is manufactured from materials selected from the group consisting of metal, metal alloy, plastic, plastic composite, and rubber.

7. The toilet bidet (110) as described in claim 1, wherein the soap dispenser (116H) is manufactured from materials selected from the group consisting of metal, metal alloy, plastic, plastic composite, and rubber.

* * * * *